US008877297B2

(12) United States Patent
Fuchita et al.

(10) Patent No.: US 8,877,297 B2
(45) Date of Patent: Nov. 4, 2014

(54) DEPOSITION METHOD

(75) Inventors: Eiji Fuchita, Chiba (JP); Eiji Tokizaki, Chiba (JP); Eiichi Ozawa, Chiba (JP)

(73) Assignee: Fuchita Nanotechnology Ltd., Chiba (JP)

( * ) Notice: Subject to any disclaimer, the term of this patent is extended or adjusted under 35 U.S.C. 154(b) by 0 days.

(21) Appl. No.: 13/993,266

(22) PCT Filed: Dec. 15, 2010

(86) PCT No.: PCT/JP2010/007272
§ 371 (c)(1),
(2), (4) Date: Jun. 11, 2013

(87) PCT Pub. No.: WO2012/081053
PCT Pub. Date: Jun. 21, 2012

(65) Prior Publication Data

US 2013/0280414 A1 Oct. 24, 2013

(51) Int. Cl.
*B05D 1/06* (2006.01)
*C23C 24/04* (2006.01)
*B05B 7/14* (2006.01)

(52) U.S. Cl.
CPC ..... *B05B 7/1404* (2013.01); *C23C 24/04* (2013.01)
USPC ..... 427/475; 427/458

(58) Field of Classification Search
USPC ..... 427/458, 475
See application file for complete search history.

(56) References Cited

U.S. PATENT DOCUMENTS

| | | | | |
|---|---|---|---|---|
| 5,800,615 | A * | 9/1998 | Lambert et al. | 118/326 |
| 6,817,550 | B2 * | 11/2004 | Taylor et al. | 239/591 |
| 2004/0126487 | A1 * | 7/2004 | Kittle et al. | 427/185 |
| 2004/0251327 | A1 * | 12/2004 | Messerly et al. | 239/690.1 |

FOREIGN PATENT DOCUMENTS

| | | | |
|---|---|---|---|
| GB | 1069423 | * | 4/1964 |
| JP | 2005-036255 | A | 2/2005 |
| JP | 2005-089826 | A | 4/2005 |
| JP | 2005-290462 | A | 10/2005 |
| JP | 2008-075149 | A | 4/2008 |
| JP | 2008-240052 | A | 10/2008 |

OTHER PUBLICATIONS

International Search Report in International Application No. PCT/JP2010/007272, filed Dec. 15, 2010.

* cited by examiner

*Primary Examiner* — Frederick Parker
(74) *Attorney, Agent, or Firm* — Saliwanchik, Lloyd & Eisenschenk

(57) ABSTRACT

A deposition method is provided to enable fine particles having a relatively large particle diameter, for example, a diameter larger than 0.5 μm, to be stably deposited on a substrate. The fine particles with insulating surface are placed in an airtight container, and a carrier gas is introduced into the container, triboelectrically charging the fine particles and generating an aerosol of the fine particles. The fine particles are charged by friction with the inner surface of a transfer tubing connected to the container, and the aerosol is conveyed via such tubing to a deposition chamber that is maintained at a pressure lower than that in the airtight container. The charged fine particles are deposited on a substrate placed in the deposition chamber.

6 Claims, 2 Drawing Sheets

DEPOSITION METHOD

CROSS-REFERENCE TO RELATED APPLICATIONS

This application is the U.S. national stage application of International Patent Application No. PCT/JP2010/007272, filed Dec. 15, 2010, the disclosure of which is incorporated herein by reference in its entirety.

TECHNICAL FIELD

The present invention relates to a deposition method using an aerosol gas deposition technique.

BACKGROUND ART

An aerosol gas deposition technique is a deposition method of converting fine particles or powders placed in an aerosol-generating container as a source material to aerosol by agitation with a carrier gas, and transporting the aerosol as the gas stream under the pressure difference between the aerosol-generating container and the deposition chamber and thus, making it collide with a substrate to synthesize a thin film on it. In the method, fine particles are accelerated to high speed on the substrate, and their kinetic energy is locally converted to heat energy on the substrate. Because the substrate heating occurs only locally, the substrate is hardly affected by the heat (normal-temperature deposition) and the deposition rate is higher than that of other deposition methods. For that reason, a film having high-density and high-adhesiveness can be generally formed.

It is considered that the optimal mean diameter of fine particles applicable for the aerosol gas deposition technique is generally about 0.5 μm. The film formation by such deposition method is performed by using the powder whose particle size close to such size condition. On the other hand, in the case where the particle diameter of such fine particles is larger than this, it is considered that the density or adhesiveness of the film is further increased. However, it has been difficult to form a film steadily.

On the other hand, the following Patent Document 1 discloses a method of converting fine particles whose surface is activated by plasma irradiation or microwave irradiation into aerosol and spraying such fine particles on a substrate. As described above, by applying some kind of energy to fine particles in question, it is possible to get rid of the existence of an inert surface caused by adsorption of any impurities on the surfaces of such fine particles or the like. Accordingly, it is possible to facilitate the formation of a construction.

Moreover, Patent Document 2 discloses an aerosol deposition apparatus including a means for ionizing an aerosol and a means for applying bias voltage opposite in polarity to that of the ion of the aerosol to a substrate. As the means for ionizing an aerosol, a high-voltage apparatus forming a non-uniform electric field, or a magnetron is exemplified. With the above-mentioned configuration, an aerosol having a predetermined concentration collides with a substrate. As a result, it is possible to deposit more fine particles on the substrate.

Patent Document 1: Japanese Patent Application Laid-open No. 2005-36255

Patent Document 2: Japanese Patent Application Laid-open No. 2005-290462

DISCLOSURE OF THE INVENTION

Problem to be Solved by the Invention

In the configurations disclosed in Patent Document 1 and Patent Document 2, however, the gas deposition apparatus needs to be equipped with a plasma generating mechanism or high-voltage generating device, which causes a problem that the apparatus in question will have a large and complicated configuration. Further, the control of such apparatus becomes complicated, and many parameters are needed to be controlled. It is expected to be difficult to form an aimed film constantly under the optimal conditions.

In view of the circumstances as described above, it is an object of the present invention to provide a deposition method that enables fine particles having a relatively large particle diameter to be deposited stably on a substrate by using a simple configuration.

Means for Solving the Problem

In order to achieve the above-mentioned object, a deposition method according to an embodiment of the present invention includes a step of placing fine particles whose surface is insulative at least in an airtight container.

An aerosol of the fine particles is generated while such fine particles are triboelectrically charged by introducing a carrier gas into the above mentioned airtight container.

The aerosol is conveyed via a transfer tubing to a deposition chamber maintained at a pressure lower than that in the airtight container in question while such fine particles are charged by friction with the inner surface of the transfer tubing, such tubing being connected to the container in question and having a nozzle at the tip.

The charged fine particles are deposited on a substrate placed in the deposition chamber by spraying the aerosol in question from the nozzle.

BEST MODE(S) FOR CARRYING OUT THE INVENTION

Figure 1:
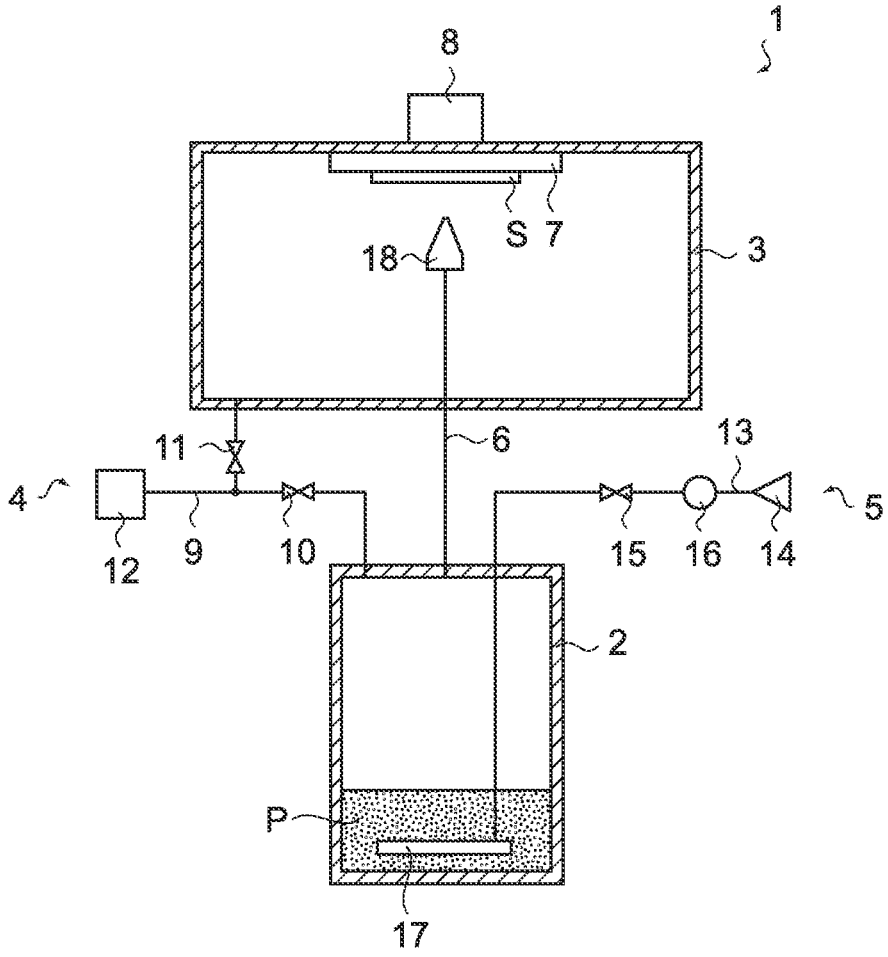
FIG. 1 is a schematic diagram showing the configuration of an aerosol gas deposition apparatus used for an embodiment of the present invention.

A deposition method according to an embodiment of the present invention includes a step of placing fine particles whose surface is at least insulative in an airtight container.

An aerosol of the fine particles in question is generated while such fine particles are triboelectrically charged by introducing a carrier gas into the airtight container in question.

The aerosol is conveyed via a transfer tubing to a deposition chamber which is maintained at a pressure lower than that in the airtight container while the fine particles in question are charged by friction with the inner surface of the transfer tubing, such tubing being connected to the airtight container and having a nozzle at the tip.

The charged fine particles are deposited on a substrate placed in the deposition chamber by spraying the aerosol from the nozzle.

In the deposition method in question, by making the particles collide with each other or by making the fine particles in question collide with the inner surface of the nozzle and the inner surface of the transfer tubing, static electricity is generated on the surfaces of such fine particles and the charged fine particles are deposited on the substrate during generation of an aerosol in an airtight container and during conveyance of the aerosol by a transfer tubing. As the electric charge amount of such fine particles becomes large, the density of the film is increased and the deposition rate is improved. The excess charges of the deposited fine particles are released into space in the deposition chamber, which causes significant light emission depending on the amount of the released charges. The light emission phenomenon is derived mainly from plasma. An electron is supplied from the side of the deposition chamber to such fine particles via plasma, which is a good conductor of electricity, thereby strengthening a bond between the fine particles in question. Thus, the adhesiveness is improved. Accordingly, it is possible to easily form even a film having a relatively large particle diameter comparing to former documents.

According to the deposition method, by the friction operation between the fine particles in the process of generating an aerosol and by the friction operation between the fine particles and the inner surface of the transfer tubing in the process of conveying the aerosol, the fine particles are charged. Therefore, an additional facility or complicated control for charging the fine particles is not needed, and it is possible to form easily a film having high-density and high-adhesiveness by using a simple configuration.

The charging operation of the fine particles in question in the process of generating an aerosol can be controlled by, for example, a flow rate of a carrier gas introduced into an airtight container. The fine particles are converted to aerosol by agitation with such carrier gas introduced into the above mentioned airtight container. At this time, as a flow rate of such carrier gas is large, the collision frequency of the fine particles is increased and the electric charge amount due to friction is increased. Then, if a flow rate of such carrier gas to be introduced into such airtight container is 58 m/s or more, the charging efficiency of the fine particles in question is increased, and if the flow rate is 135 m/s or more, the charging efficiency is further increased. As a result, it is possible to form a film stably.

On the other hand, the charging of the fine particles in the process of conveying an aerosol is mainly caused by the collision of the fine particles in question with the inner surface of the nozzle and the inner surface of the transfer tubing. Therefore, the charging state of such fine particles can be adjusted by the pressure difference between the airtight container and the deposition chamber, the length of the transfer tubing, the inner diameter of the transfer tubing, the opening shape of the nozzle, or the like.

The charging of the fine particles in question in the process of conveying an aerosol can be adjusted by the opening shape of the nozzle provided at the tip of the transfer tubing. For example, by forming the opening of the nozzle to have a slot shape having a length 10 times or more and 1000 times or less its width, the charging efficiency of the fine particles in question in the transfer tubing is increased, and the deposition efficiency is improved.

As the above mentioned fine particles applied to the deposition method, such fine particles at least whose surface is an insulator are used. Examples of such fine particles include insulator fine particles such as alumina, zirconia, yttria, silica, glass, and forsterite, and conductor particles whose surface is coated with an insulating coating film, such as metal. The particle diameter of such fine particles is not particularly limited. However, for example, fine particles in question having a mean particle diameter of 0.5 μm or more and 10 μm or less can be applied.

The inner surface of the nozzle may be coated with a conductive carbide or ultrahard material such as TiN, TiC, and WC. Accordingly, it is possible to reduce the attrition of the inner surface of the nozzle due to the collision with such fine particles, and to ensure stable deposition and high accuracy of film thickness for a long time.

In the deposition method, the fine particles in question may be deposited on the substrate while reciprocating the substrate in the deposition chamber. Accordingly, it is possible to form a film of such fine particles having a desired thickness. Moreover, in the deposition method, such fine particles collide with the surface of the substrate and charges are exchanged between the substrate and the fine particles, thereby increasing the density and adhesiveness of the film. At this time, depending on the charging state of such fine particles deposited on the substrate earlier, the exchange of charges may be disturbed when such fine particles that reach the substrate later are deposited. Therefore, a movement rate of the substrate is favorably a predetermined rate or more, and is set to, for example, 5 mm/s or more.

Hereinafter, embodiments of the present invention will be described with reference to drawings.

FIG. 1 is a diagram showing the schematic configuration of an aerosol gas deposition apparatus 1 (hereinafter, AGD apparatus 1) according to an embodiment of the present invention.

As shown in the Figure, the AGD apparatus 1 has an aerosol-generating container 2 (closed contained), a deposition chamber 3 (deposition chamber), an exhaust system 4, a gas-supplying system 5, and a transfer tubing 6. The aerosol-generating container 2 and the deposition chamber 3 form respective independent chambers, and internal spaces of the chambers are connected to each other by the transfer tubing 6. The exhaust system 4 is connected to the aerosol-generating container 2 and the deposition chamber 3. The gas-supplying system 5 is connected to the aerosol-generating container 2. Moreover, an aerosol raw material P is placed in the aerosol-generating container 2. A substrate S is placed in the deposition chamber 3.

The aerosol-generating container 2 stores the aerosol raw material P and generates an aerosol therein. The aerosol-generating container 2 is connected to a ground potential and has a tightly sealable structure with a capped region (not shown) for introduction and removal of the aerosol raw material P. The aerosol-generating container 2 is connected to the exhaust system 4 and the gas-supplying system 5. The AGD apparatus 1 may additionally have a vibration mechanism of vibrating the aerosol-generating container 2 for agitation of the aerosol raw material P or heating means for heating the container for degassing (removal of water and the like) of the aerosol raw material P.

The deposition chamber 3 stores the substrate S. The deposition chamber 3 is configured to keep its internal pressure constant. The deposition chamber 3 is connected to the exhaust system 4. Moreover, the deposition chamber 3 has a stage 7 for fixation of the substrate S and a stage-driving mechanism 8 for movement of the stage 7. The stage 7 may have heating means for heating the substrate S for degassing of the substrate S before deposition. In addition, the deposition chamber 3 may have a vacuum gauge indicating the internal pressure. The deposition chamber 3 and the stage 7 are connected to a ground potential.

The exhaust system 4 evacuates the aerosol-generating container 2 and the deposition chamber 3 under vacuum. The exhaust system 4 has a vacuum tubing 9, a first valve 10, a second valve 11, and a vacuum pump 12. The vacuum tubing 9 connected to the vacuum pump 12 is branched and connected to the aerosol-generating container 2 and the deposition chamber 3. The first valve 10 is installed on the vacuum tubing 9 between the branch point of the vacuum tubing 9 and the aerosol-generating container 2 in such a manner that vacuum evacuation of the aerosol-generating container 2 can be blocked. The second valve 11 is installed on the vacuum tubing 9 between the branch point of the vacuum tubing 9 and the deposition chamber 3 in such a manner that vacuum evacuation of the deposition chamber 3 can be blocked. The configuration of the vacuum pump 12 is not particularly limited, and the vacuum pump 12 may have multiple pump units. The vacuum pump 12 may be, for example, a mechanical booster pump and a rotary pump that are connected in series.

The gas-supplying system 5 supplies a carrier gas for specifying the pressure of the aerosol-generating container 2 and generating an aerosol to the aerosol-generating container 2. Examples of the carrier gas include $N_2$, Ar, He, $O_2$, and dry air. The gas-supplying system 5 has a gas tubing 13, a gas source 14, a third valve 15, a gas flowmeter 16, and a gas-blowout unit 17. The gas source 14 and the gas-blowout unit 17 are connected to each other through the gas tubing 13 and the third valve 15 and the gas flowmeter 16 are installed on the gas tubing 13. The gas source 14 is, for example, a gas cylinder, and supplies the carrier gas. The gas-blowout unit 17, which is installed in the aerosol-generating container 2, uniformly blows out the carrier gas supplied through the gas tubing 13. The gas-blowout unit 17 may be, for example, a hollow unit having many gas-blowout holes, and may convert the aerosol raw material P to aerosol by effective agitation, as it is located at the position embedded in the aerosol raw material P. The gas flowmeter 16 indicates the flow rate of the carrier gas flowing in the gas tubing 13. The third valve 15 is configured to be capable of regulating the flow rate of the carrier gas flowing in the gas tubing 13 or blocking the carrier gas.

The transfer tubing 6 conveys the aerosol formed in the aerosol-generating container 2 into the deposition chamber 3. The transfer tubing 6 is connected to the aerosol-generating container 2 at one end. The transfer tubing 6 has a nozzle 18 provided at the other end thereof. The nozzle 18 has a small round or slit-shaped opening and the blowout rate of the aerosol is specified by the diameter of the opening of nozzle 18, as will be described below. The nozzle 18 is installed at a position facing the substrate S. Moreover, the nozzle 18 is connected to a nozzle moving mechanism (not shown) specifying the position and the angle of the nozzle 18 for specification of the distance and angle of the ejected aerosol to the substrate S. The transfer tubing 6 and the nozzle 18 are connected to a ground potential.

The inner surface of the transfer tubing 6 is formed of a conductor. Typically, as the transfer tubing 6, a linear metal tubing such as a stainless tubing is used. The length and inner diameter of the transfer tubing 6 can be appropriately set. For example, the length is 300 mm to 1000 mm, and the inner diameter is 4.5 mm to 24 mm.

The opening shape of the nozzle 18 may be circular or slot-like. In this embodiment, the opening shape of the nozzle 18 is slot-like, and the length of the opening is 10 times or more and 1000 times or less its width. If the ratio between length and width of the opening is less than 10 times, it is difficult to effectively charge particles in the nozzle. Moreover, if the ratio between length and width of the opening exceeds 1000 times, the charging efficiency of such fine particles can be increased. However, the spraying amount of fine particles in question is restricted, and the deposition rate is significantly decreased. The ratio between length and width of the opening of the nozzle is favorably 20 times or more and 800 times or less, and more favorably, 30 times or more and 400 times or less.

The substrate S is made of a material such as glass, metal, and ceramic. As described above, the AGD method is a deposition method performed at normal temperature and also a physical deposition method without any chemical processing, and thus, allows a wide variety of selection of materials as the substrate. In addition, the substrate S is not limited to one having a flat shape and may be three-dimensional.

The AGD apparatus 1 is configured in such a manner. It should be noted that the configuration of the AGD apparatus 1 is not limited to that described above. For example, a gas-supplying mechanism different from the gas-supplying system 5, which is connected to the aerosol-generating container 2, may be additionally installed. In the configuration described above, the pressure in the aerosol-generating container 2 is adjusted and an aerosol is formed by agitation of the aerosol raw material P by the carrier gas supplied by the gas-supplying system 5. It should be noted that it is possible, by separately supplying the gas for pressure adjustment from the different gas-supplying means, to regulate the pressure in the aerosol-generating container 2, independently of the generation state of aerosol (generation amount, diameter of the main particles agitated, etc.).

The aerosol raw material P is converted to aerosol in the aerosol-generating container 2 and is deposited on the substrate S. As the aerosol raw material P, fine particles at least whose surface is insulative are used. Examples of such fine particles include insulator fine particles such as alumina fine particles, zirconia fine particles, and yttria fine particles. Other examples of the fine particles include conductor fine particles whose surface is coated with an insulating coating film, such as metal. The particle diameter of the aerosol raw material P is not particularly limited. However, for example, fine particles having a mean particle diameter ($D_{50}$) of 0.5 μm or more and 10 μm or less can be applied.

Figure 2:
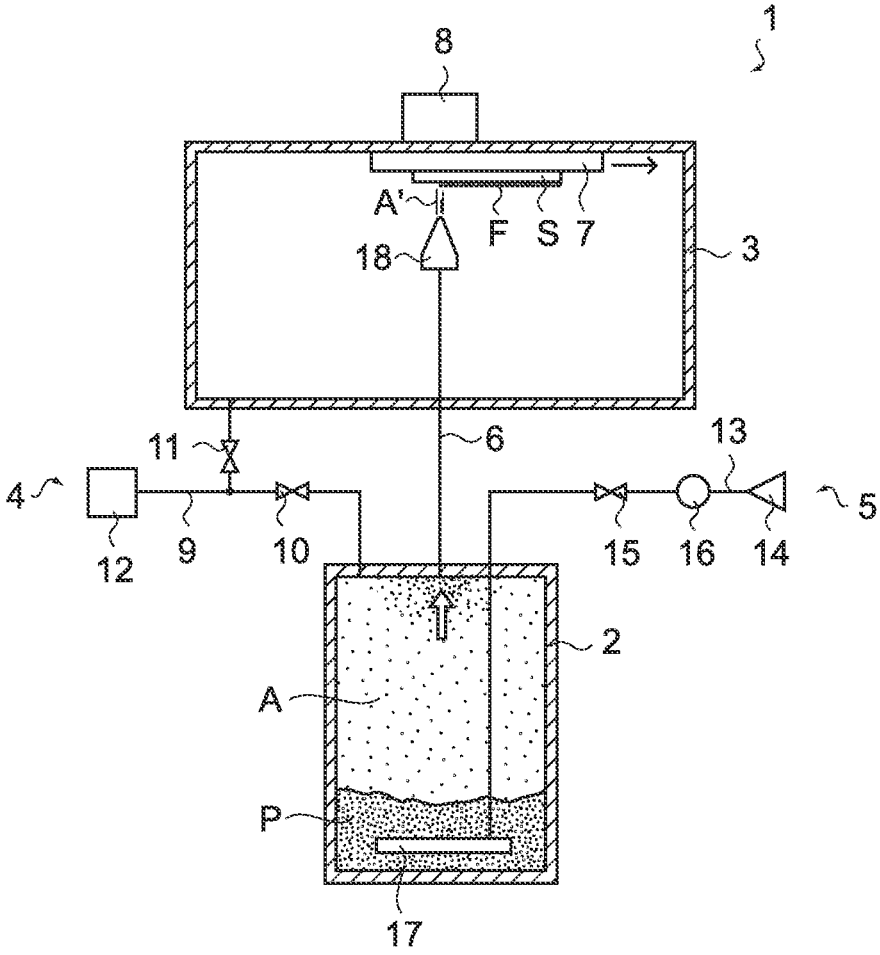
FIG. 2 is a schematic diagram for explaining an operation of the aerosol gas deposition apparatus.

Next, a deposition method according to this embodiment will be described with reference to FIG. 2. FIG. 2 is a schematic diagram for explaining an operation of the AGD apparatus 1. Hereinafter, a typical deposition method using the AGD apparatus 1 will be described.

A predetermined amount of aerosol raw material P is placed in the aerosol-generating container 2. It should be noted that the aerosol raw material P may be previously degassed under heat. Alternatively, the aerosol-generating container 2 may be heated with the aerosol raw material P placed inside, for degassing of the aerosol raw material P. It is possible, by degassing of the zirconia fine particles, to prevent aggregation of the zirconia fine particles by water or contamination of the thin film with impurities.

Next, the aerosol-generating container 2 and the deposition chamber 3 are evacuated under vacuum by the exhaust system 4.

The first valve 10 and the second valve 11 are turned open while the vacuum pump 12 is in operation for vacuum evacuation of the aerosol-generating container 2 and the deposition chamber 3 to a sufficiently low pressure. When the pressure in the aerosol-generating container 2 is sufficiently reduced, the first valve 10 is turned closed. It should be noted that the deposition chamber 3 is vacuum-evacuated during deposition.

Next, a carrier gas is introduced into the aerosol-generating container 2 by the gas-supplying system 5. The third valve 15 is turned open, and the carrier gas is blown out through the gas-blowout unit 17 into the aerosol-generating container 2. The pressure in the aerosol-generating container 2 increases by the carrier gas introduced into the aerosol-generating container 2. Moreover, the aerosol raw material P is agitated by the carrier gas blown out from the gas-blowout unit 17, as shown in FIG. 2 and floats in the aerosol-generating container, forming an aerosol containing the aerosol raw material P dispersed in the carrier gas (shown by A in FIG. 2). The generated aerosol flows into the transfer tubing 6 by the pressure difference between the aerosol-generating container 2 and the deposition chamber 3 and is ejected from the nozzle 18. It is possible to control the pressure difference between the aerosol-generating container 2 and the deposition chamber 3 and the state of aerosol formation by adjustment of the opening of the third valve 15.

The aerosol (represented by A' in FIG. 2) ejected from the nozzle 18 is ejected at a flow rate specified by pressure difference between the aerosol-generating container 2 and the deposition chamber and the diameter of the opening of the nozzle 18. This aerosol reaches the surface of the substrate S or a ready-made film, and the aerosol raw material P contained in the aerosol, i.e., zirconia fine particle, collides with the surface of the substrate S or the ready-made film. The kinetic energy of the aerosol raw material P is locally converted into heat energy, and the particles are entirely or partially melt to be bonded together. Thus a film is formed.

By moving the substrate S, a zirconia thin film (represented by F in FIG. 2) is formed in a predetermined range on the substrate S. Movement of the stage 7 by the stage-driving mechanism 8 changes the relative position of the substrate S to the nozzle 18. It is possible, by moving the stage 7 in one direction in parallel with the deposition surface of the substrate S, to form a linear thin film having a width identical with the diameter of the opening of nozzle 18. It is possible to further form a film on a ready-made film by reciprocating the stage 7 and thus to form a zirconia thin film having a predetermined film thickness. In addition, two-dimensional movement of the stage 7 gives a thin film formed in a predetermined region. The angle of the nozzle 18 to the deposition face of the substrate S may be vertical or inclined. By placing the nozzle 18 obliquely to the deposition surface, even if the aggregates of fine particles that reduce the deposition quality deposit, it is possible to remove the deposition.

In the deposition method according to this embodiment, by making the fine particles constituting a raw material P collide with each other or by making the fine particles collide with the inner surfaces of the transfer tubing 6 and the nozzle 18, static electricity is generated on the surfaces of the fine particles in question and such charged fine particles are deposited on the substrate during generation of an aerosol A and during conveyance of the aerosol A by the transfer tubing 6. As the electric charge amount of the fine particles in question becomes large, the density of the film is increased and the deposition rate is improved. The excess charges of the deposited fine particles are released into space in the deposition chamber, which causes significant light emission depending on the amount of the released charges. This light emission phenomenon is derived mainly from plasma. An electron is supplied from the side of the deposition chamber 3 to such fine particles via plasma, which is a good conductor of electricity, thereby strengthening a bond between the fine particles in question. Thus, the adhesiveness is improved. Accordingly, it is possible to easily form even a film having a relatively large particle diameter.

The charging operation of the above mentioned fine particles in the process of generating an aerosol can be controlled by a flow rate of the carrier gas introduced into the aerosol-generating container 2. The fine particles in question are converted to aerosol by agitation with the carrier gas. At this time, as a flow rate of the gas is large, the collision frequency in the container inner wall or of such fine particles is increased and the electric charge amount due to friction is increased. In this embodiment, by setting a flow rate of the carrier gas to 58 m/s or more, the charging probability of such fine particles is increased, and stable deposition is achieved.

Table 1 shows experimental results obtained when a film is formed with different flow rates (emission rate) of the carrier gas introduced into the aerosol-generating container 2 and different sizes of opening of the nozzle 18. In this Example, a flow rate of the gas is adjusted with a fixed supplying flow rate (12 L/min) of the carrier gas and different, and with different diameters of holes and numbers of the gas-blowout unit 17. In the Table, a numerical value in a parenthesis is the pressure in the aerosol-generating container 2. As the raw material P, alumina fine particles having a mean particle diameter of 0.5 μm is used. Moreover, nitrogen is used as the carrier gas, and the opening shape of the nozzle 18 is a slot shape having a length of 30 mm and a width of 0.3 mm (or 0.15 mm). The deposition time period in each experimental example is arbitrarily determined, and the consumption rate of the raw material is calculated based on the amount of the raw material P before and after the deposition.

TABLE 1

| Experimental example | Gas supplying amount (L/min) | Diameter and number of gas emitting hole | Gas emitting flow rate (m/s) | Film thickness (μm) | Nozzle opening (mm × mm) | Deposition time period (min) | Consumption amount/charge amount of powder |
|---|---|---|---|---|---|---|---|
| 1-1 | 12 | ϕ0.8 mm 6 | 265 (25 kPa) | 35 | 30 × 0.3 | 50 | 43 g/80 g (0.86 g/min) |
| 1-2 | 12 | ϕ0.8 mm 12 | 133 (25 kPa) | 5 | 30 × 0.3 | 75 | 32 g/80 g (0.43 g/min) |
| 1-3 | 12 | ϕ0.8 mm 12 | 82.9 (40 kPa) | 10 | 30 × 0.15 | 60 | 23 g/80 g (0.38 g/min) |
| 1-4 | 12 | ϕ0.8 mm 12 | 195 (17 kPa) | 1 | 30 × 0.6 | 60 | 39 g/80 g (0.49 g/min) |

As shown in Table 1, if an experimental example (1-1) is compared to an experimental example (1-2), which use the same nozzle opening diameter, the film thickness in the experimental example (1-1) is larger than that in the experimental example (1-2). This represents that the collision frequency between fine particles is increased because the agitation efficiency of such fine particles is increased as a flow rate of the carrier gas becomes large, resulting in improved charging efficiency of such fine particles and improved deposition rate.

Moreover, if an experimental example (1-3) is compared to an experimental example (1-4), a flow rate of the gas in the experimental example (1-4) is larger than that in the experimental example (1-3). However, the film thickness in the experimental example (1-4) is smaller than that in the experimental example (1-3). This represents that the charging efficiency of fine particles is associated with not only the flow rate of the carrier gas but also the size of the opening of the nozzle. Specifically, by adjusting the conductance in the transfer tubing by the size of the opening of the nozzle and increasing the charging efficiency due to the collision of the inner surface of the transfer tubing with the fine particles, it is possible to achieve stable deposition.

Table 2 shows experimental results that represent a relationship between the supplying flow rate of a carrier gas and a flow rate. The flow rate of the carrier gas that agitates fine particles can be adjusted by the flow rate of the carrier gas introduced into the gas-blowout unit 17. By increasing the flow rate of the gas, the particle concentration of an aerosol is increased and the deposition rate can be improved.

TABLE 2

| Experimental example | Gas supplying amount (L/min) | Diameter and number of gas emitting hole | Gas emitting flow rate (m/s) | Film thickness (μm) | Nozzle opening (mm × mm) | Deposition time period (min) | Consumption amount/charge amount of powder |
|---|---|---|---|---|---|---|---|
| 2-1 | 12 | φ0.8 mm 6 | 265 (25 kPa) | 35 (50 pass) | 30 × 0.3 | 50 | 43 g/80 g (0.86 g/min) |
| 2-2 | 10 | φ0.8 mm 6 | 230 (24 kPa) | 10 (100 pass) | 30 × 0.3 | 85 | 56 g/100 g (0.66 g/min) |
| 2-3 | 8 | φ0.8 mm 6 | 210 (21 kPa) | 5 (77 pass) | 30 × 0.3 | 62 | 40 g/100 g (0.65 g/min) |

Table 3 shows experimental results obtained when a similar experiment to those described above has been conducted with using zirconia fine particles as the raw material P. The mean particle diameter of zirconia fine particles is 7.4 μm. The flow rate of the carrier gas has been adjusted by the supplying flow rate, the diameter of the hole of the gas-blowout unit 17, and the number of the gas-blowout unit 17.

TABLE 3

| Experimental example | Gas supplying amount (L/min) | Diameter and number of gas emitting hole | Gas emitting flow rate (m/s) | Film thickness (μm) | Nozzle opening (mm × mm) | Deposition time period (min) |
|---|---|---|---|---|---|---|
| 3-1 | 70 | φ1.2 mm 34 | 58 (49 kPa) | 7 | 100 × 0.3 | 3 |
| 3-2 | 60 | φ1.2 mm 34 | 55 (44 kPa) | Nothing | 100 × 0.3 | 3 |
| 3-3 | 30 | φ1.2 mm 12 | 108 (34 kPa) | 9 | 100 × 0.3 | 3 |
| 3-4 | 20 | φ1.2 mm 12 | 84 (29 kPa) | 3 | 100 × 0.3 | 3 |
| 3-5 | 10 | φ1.2 mm 12 | 49 (25 kPa) | Less than 0.1 | 100 × 0.3 | 3 |
| 3-6 | 20 | φ1.2 mm 6 | 175 (28 kPa) | 5.5 | 100 × 0.3 | 3 |
| 3-7 | 10 | φ1.2 mm 6 | 102 (24 kPa) | 3 | 100 × 0.3 | 3 |

As shown in Table 3, if the flow rate of the carrier gas is 58 m/s or more, it is possible to make a film having a thickness of 3 μm or more at the deposition time period of 3 minutes. On the other hand, if the flow rate of the carrier gas is less than 58 m/s, it is impossible to make a film or only a film thickness of submicron order is obtained. The main reason for these results is considered to be insufficient charging of fine particles. Therefore, this shows that it is very difficult to efficiently form a film having a desired thickness under such conditions.

Next, the charging effect of zirconia fine particles (having a mean particle diameter of 7.4 μm) in the process of conveying and spraying an aerosol by the transfer tubing 6 and the nozzle 18 is considered. The aerosol that has passed through the transfer tubing 6 is sprayed after the collision with not only the inner surface of the transfer tubing 6 but also the inner surface of the nozzle 18. In particular, in the case where the conductance in the nozzle 18 is small, the charging of fine particles is predominantly frictional charging in the nozzle 18. Table 4 shows experimental results that represent a relationship between the material of the inner surface of the nozzle 18 and the thickness and color of a film to be formed.

TABLE 4

| Experimental example | Material of inner surface of nozzle | Gas supplying flow rate (L/min) | Pressure in aerosol chamber (kPa) | Pressure in deposition chamber (kPa) | Film thickness (5 m/s, 100 pass) | Film color | Deposition time period, nozzle opening (mm × mm) |
|---|---|---|---|---|---|---|---|
| 4-1 | Stainless | 120 | 74 | 0.61 | 20 μm | Black | 3 mim 100 × 0.3 |
| 4-2 | Polyimide tape | 120 | 150 | 0.62 | 1.5 μm | Light brown | 3 mim 100 × 0.15 |
| 4-3 | Stainless | 160 | 93 | 0.92 | 35 μm | Black | 3 mim 100 × 0.3 |
| 4-4 | Stainless | 60 | 48 | 0.27 | 3.5 μm | Brown | 3 mim 100 × 0.3 |
| 4-5 | Polyimida tape | 60 | 100 | 0.27 | Less than 0.1 μm | Light brown | 3 mim 100 × 0.15 |
| 4-6 | TiN/SUS | 120 | 75 | 0.61 | 20 μm | Black | 3 mim 100 × 0.3 |

The nozzle 18 including a narrow opening (aperture) that sprays gas conveying particles is made of stainless steel (SUS) having conductivity. In the process of conveying a gas, a position having small conductance is a nozzle portion, and static electricity is likely to be applied to fine particles by the friction between the inner surface of the nozzle and the particles. At this time, if the inner surface of the nozzle is insulative, it is impossible to apply static electricity to the particles in question that are successively supplied. For example, an insulating tape (polyimide tape) was attached to the inner surface of the nozzle to form a zirconia film. As a result, the deposition rate was not more than one tenth of that in the case where the inner surface of the nozzle was SUS (experimental examples (4-2) and (4-5)). The reason for these results is considered to be that the fine particles in question are not sufficiently charged when passing through the nozzle. Specifically, it is considered that only particles charged in the aerosol-generating chamber and the transfer tubing contribute to the deposition.

The polarity of static electricity applied to fine particles in question is determined by the triboelectric series. In this example, such fine particles are charged to positive. Taking zirconia as an example, it has been known that zirconia particles charged to positive is synonymous with the reduction of zirconia particles, and a white zirconia powder is partially blackened by the reduction. The film obtained in an experimental example (4-1), (4-3), (4-4), or the like includes the deposition of the zirconia powder blackened by the charge, i.e., reduction. Because such a zirconia powder can have a large amount of charge, it is possible to form a zirconia film having a desired film thickness in a short time. It should be noted that the zirconia film with black color is whitened by being heated in the atmosphere at the temperature of 1000° C. or more. At this time, there is no change in the adhesiveness of the film.

On the other hand, if the zirconia fine particles have small amount of charge, the color of a film to be formed is white or brownish (experimental examples (4-2) and (4-5)). Because it is considered that such a zirconia powder is rarely charged, the deposition efficiency was bad and the obtained film thickness was small.

Furthermore, the inner surface of the nozzle may be coated with a conductive carbide or ultrahard carbide material such as titanium nitride (TiN), titanium carbide (TiC), and tungsten carbide (WC). Also in this case, there is no influence on the deposition properties (experimental example (4-6)). The attrition of the nozzle whose inner surface was subjected to TiN coating due to the friction with fine particles was not observed even after the nozzle was used for 300 hours. On the other hand, the attrition of the nozzle whose inner surface was made of SUS due to the friction with fine particles was observed after the nozzle was used for 100 hours. In order to obtain the film thickness accuracy, the width of the opening of the nozzle needs to be maintained and conserved and it is important to apply TiN coating for providing resistance to attrition.

Next, the influence on the deposition properties due to application of voltage to the substrate S is considered.

Most of ceramic particles such as zirconia particles and alumina particles are charged to positive in the aerosol-generating container 2, the transfer tubing 6, and the nozzle 18. In view of the above, because the fine particles emitted from the nozzle are accelerated toward the substrate S by an electrostatic attractive force if the substrate S in the deposition chamber 3 is maintained at a negative potential, the kinetic energy is improved and the deposition efficiency of the particles on the substrate S is increased. Table 5 shows evaluation results of the deposition thickness with/without application of a potential to the substrate S.

TABLE 5

| Experimental example | Application of voltage to substrate (V) | Gas supplying flow rate (L/min) | Pressure in aerosol chamber (kPa) | Pressure in deposition chamber (kPa) | Film thickness (5 ms/s) | Film color | Deposition time period, nozzle opening (mm × mm) |
|---|---|---|---|---|---|---|---|
| 5-1 | 0 | 120 | 74 | 0.61 | 20 μm (100 pass) | Black | 3 mim 100 × 0.3 |
| 5-2 | −100 | 120 | 74 | 0.61 | 30 μm (50 pass) | Black | 3 mim 100 × 0.3 |

As shown in Table 5, in the case where negative voltage is applied to the substance S, it is possible to obtain a high deposition rate compared to the case where no potential is applied to the substrate S. The application of voltage to the substrate S can be realized by application of voltage to the stage 7. Moreover, the magnitude of voltage applied to the substrate S is not limited to 100 V, and may be appropriately set. Moreover, it does not necessarily need to apply negative voltage to the substrate S, and desired deposition properties can be obtained even in the case of no potential (experimental example (5-1)).

In the deposition method according to this embodiment, the charged fine particles collide with the surface of the substrate S and charges are exchanged between the substrate and the fine particles, thereby increasing the density and adhesiveness of the film. At this time, depending on the charging state of the fine particles deposited on the substrate earlier, the exchange of charges may be disturbed when the fine particles that reach the substrate later are deposited. In the case where the deposition rate of particles is high, a uniform dense film having high adhesive force cannot be formed unless the substance is sent fast. Therefore, a movement rate of the substrate is favorably a predetermined rate or more, and is set to, for example, 5 mm/s or more.

Table 6 shows experimental results obtained by examining a relationship between the movement rate of the substrate S and the deposition properties. As such fine particles, an yttria partially stabilized zirconia powder (having a mean particle diameter of 4.6 μm) was used. As shown in Table 6, in the case where the movement rate of the substrate is 1 mm/s, the obtained film has poor adhesiveness, and partial removal of the film was observed. On the other hand, in the case where the movement rate of the substrate is 5 mm/s or more, the film has high adhesiveness, and no removal of the film was observed.

TABLE 6

| Experimental example | Gas supplying flow rate (L/min) | Movement rate of substrate (mm/s) | Number of times of lamination (pass) | Film thickness (μm) | Deposition properties | Nozzle opening (mm × mm) |
|---|---|---|---|---|---|---|
| 6-1 | 120 | 1 | 50 | 5 | Partial removal | 100 × 0.3 |
| 6-2 | 120 | 5 | 250 | 15 | Uniform dense film | 100 × 0.3 |
| 6-3 | 120 | 30 | 1500 | 10 | Uniform dense film | 100 × 0.3 |

As described above, according to this embodiment, by the friction operation between the fine particles in the process of generating an aerosol and by the friction operation between the fine particles and the inner surface of the transfer tubing in the process of conveying the aerosol, the fine particles are charged. Therefore, an additional facility or complicated control for charging the fine particles is not needed, and it is possible to easily form a film having high-density and high-adhesiveness by using a simple configuration.

Moreover, in the deposition method according to this embodiment, static electricity is generated on the surfaces of the fine particles and the charged fine particles are deposited on the substrate. As the electric charge amount of the fine particles becomes large, the density of the film is increased and the deposition rate is improved. The excess charges of the deposited fine particles are released into space in the deposition chamber, which causes significant light emission depending on the amount of the released charges. This light emission phenomenon is derived mainly from plasma. An electron is supplied from the side of the deposition chamber to the fine particles via plasma, which is a good conductor of electricity, thereby strengthening a bond between the fine particles. Thus, the adhesiveness is improved. Accordingly, it is possible to easily form even a film having a relatively large particle diameter (e.g., more than 1 μm diameter).

The deposition mechanism of the charged fine particles is considered as follows, for example. In the case where the substrate is formed of an insulating material, the surface of the substrate is polarized to negative by electrostatic induction when particles charged to positive approach the substrate. Accordingly, Coulomb's force acts between the particles and the surface of the substrate, and the particles are electrostatically bonded to the substrate as they approach the substrate. The adhesiveness of the film on the substrate is considered to mainly depend on the impact force caused by the collision with the substrate and Coulomb's force. Moreover, the density of the film is considered to depend on that the particles are pulverized to, for example, about 100 nm by the impact force and Coulomb's force described above, and densely deposited.

Moreover, charges of the amount exceeding the charging capacity of the particles and substrate are discharged with emission of bluish white light toward the portion having a low potential in the deposition chamber (e.g., wall surface in the chamber). For example, in the above-mentioned experimental example (1-1), light emission that can be visually confirmed was observed. At this time, by turning nitrogen being a carrier gas into plasma, red violet light is emitted in some cases.

EXAMPLES

Example 1

Eighty g of an alumina powder having a mean particle diameter of 0.5 μm was put in an alumina tray, and was heated for 1 hour at the temperature of 250° C. in the atmosphere. After that, the alumina powder was quickly transferred to an aerosol-generating container made of glass and was vacuum-evacuated to 10 Pa or less. In order to facilitate the degassing of the powder, the aerosol-generating container was heated at the temperature of 150° C. by a mantle heater.

The exhaust valve of the aerosol-generating container was closed, and a nitrogen gas for agitation (carrier gas) was supplied at 12 L/min. The alumina powder in the aerosol-generating container (at the pressure of about 25 kPa) was converted to aerosol, and then was sprayed and deposited on an aluminum substrate provided on a stage in the deposition chamber (at the pressure of about 800 Pa) through a transfer tubing and a nozzle (opening 30 mm×0.3 mm). The substrate was reciprocated at the movement rate of 1 mm/s, and a film of 50 layers having a length of 30 mm was formed. The deposition time period was about 25 minutes. A blackish alumina film having a film thickness of 35 μm, the area of 30 mm×30 mm, and transparency, was formed. A film whose film quality was dense having high adhesiveness to the aluminum substrate was obtained.

Example 2

Three hundred g of a zirconia powder having a mean particle diameter of 7.4 μm was put in an alumina tray, and was heated for 1 hour at the temperature of 300° C. in the atmosphere. After that, the zirconia powder was quickly transferred to an aerosol-generating container made of SUS and vacuum-evacuated to 10 Pa or less. In order to facilitate the degassing of the powder, the aerosol-generating container was heated at the temperature of 150° C. by a mantle heater.

The exhaust valve of the aerosol-generating container was closed, and a nitrogen gas for agitation (carrier gas) was supplied at 70 L/min. The zirconia powder in the aerosol-generating container (at the pressure of about 49 kPa) was converted to aerosol, and then was sprayed and deposited on an aluminum substrate provided on a stage in the deposition chamber (at the pressure of about 200 Pa) through a transfer tubing and a nozzle (opening 100 mm×0.3 mm). The substrate was reciprocated at the movement rate of 5 minis, and a film of 100 layers having a length of 10 mm was formed. The deposition time period was about 3 minutes. A blackish zirconia film having a film thickness of 7 μm, the area of 100 mm×10 mm, and transparency, was formed. A film whose film quality was dense having high adhesiveness to the aluminum substrate was obtained.

Although embodiments of the present invention have been described, the present invention is not limited to this and various modifications can be made based on technical ideas of the present invention.

For example, in the embodiments, the description was made using alumina fine particles or zirconia fine particles as a raw material powder. However the present invention is not limited to these examples, and can be also applied to other ceramic fine particles such as yttria fine particles. Moreover, the present invention is not limited to the ceramic fine particles, and can be also applied to conductor fine particles whose surface is insulating-coated with an oxide film or nitride film, such as metal.

DESCRIPTION OF SYMBOLS

1 aerosol gas deposition apparatus (AGD apparatus)
2 aerosol-generating container
3 deposition chamber
6 transfer tubing
18 nozzle
S substrate

The invention claimed is:

1. A deposition method, comprising:

placing particles whose surfaces are at least insulative in an airtight container;

generating an aerosol of the particles while triboelectrically charging the particles by introducing a carrier gas into the airtight container;

transporting the aerosol via a transfer tubing to a deposition chamber that is a sealed enclosure and is configured to maintain a controlled constant pressure lower than that in the airtight container while charging the particles by friction with an inner surface of the transfer tubing connected to the airtight container and having a nozzle at a tip; and depositing the charged particles on a substrate placed in the deposition chamber by spraying the aerosol from the nozzle.

2. The deposition method according to claim 1, wherein an inner surface of the nozzle is coated with a conductive carbide.

3. The deposition method according to claim 1, wherein a flow rate of the carrier gas to be introduced into the airtight container is 58 m/s or more.

4. The deposition method according to claim 3, wherein the nozzle has an opening with a slot shape, wherein the opening has a length that is 10 to 1000 times longer than a width of the opening.

5. The deposition method according to claim 1, wherein the particles are deposited on the substrate while reciprocating the substrate in the deposition chamber at a movement rate of 5 mm/s or more.

6. The deposition method according to claim 1, wherein the particles have a mean particle diameter between 0.5 μm and 10 μm.

* * * * *